United States Patent [19]

Murray

[11] 4,410,232

[45] Oct. 18, 1983

[54] TERMINAL STAKING ARTICLE AND PROCESS

[75] Inventor: Phillip J. Murray, Southampton, Pa.

[73] Assignee: Continental-Wirt Electronics Corp., Southampton, Pa.

[21] Appl. No.: 336,626

[22] Filed: Jan. 4, 1982

[51] Int. Cl.[3] ..... H01R 9/16

[52] U.S. Cl. ..... 339/220 R; 29/844

[58] Field of Search ..... 339/217 R, 220 R; 29/513, 842, 844, 845

[56] References Cited

U.S. PATENT DOCUMENTS

| | | | |
|---|---|---|---|
| 2,293,596 | 8/1942 | Del Camp | 339/220 R |
| 2,625,723 | 1/1953 | Bassett | 29/513 |
| 2,993,188 | 7/1961 | Anderson | 339/220 R |

*Primary Examiner*—John McQuade
*Assistant Examiner*—Gary F. Paumen
*Attorney, Agent, or Firm*—Ostrolenk, Faber, Gerb & Soffen

[57] ABSTRACT

A thin, flat conductive terminal strap is rigidly fastened to an insulation support board. The support board has two spaced, parallel slots into which a U-shaped end of the strap is dropped. A portion of one leg of the U near its base has a length slightly longer than the distance between the slots. When the later leg is bent upwardly to wrap the strap around the material between the slots, its end, which has an extension region, engages a frangible region in the opposite leg just beneath the support board and distorts the frangible region beyond the edge of the slot which receives the leg with the frangible region. The extension is slightly narrower than the frangible region. Thus, the entire strap is securely staked to the terminal board. The opposite surface of the terminal strap may serve as a contact which makes sliding contact with a sliding wiper. An array of a plurality of such terminals may be formed on a common insulation board. The frangible region can be formed by stamping a weakened region in the terminal strap before it is bent to its U shape.

10 Claims, 8 Drawing Figures

A
B
C
D
E
F
G
34
40
41
42
43
50

TERMINAL STAKING ARTICLE AND PROCESS

BACKGROUND OF THE INVENTION

This invention relates to electrical terminal structures, and more specifically relates to a novel insulation board mounted terminal strap structure in which terminals are securely fastened to the insulation board.

The securement of thin, conductive terminal straps to a common insulation board is quite well known. For example, in many well-known relatively low power switches an electrical contact is fixed to one surface of an insulation board and has an elongated terminal extending through the board and outwardly from the board to serve as a solderable or plug-in terminal. The contact portion of the strap lies flat over the top surface of the insulation board and can make contact with a sliding contact mounted for movement in the same housing which receives the insulation board and its terminals. There are other well-known applications for electrical terminals which are secured to an insulation board.

It is necessary that these devices be inexpensive but that they have great reliability since a failure by loosening of a simple inexpensive terminal could disable an appliance or the like. Various methods have been used for securing the terminal to the insulation board. One known method which is relatively inexpensive is to bend the terminal to a U shape, and then insert the terminal strap through spaced slots in the board. A short leg of the U-shaped strap is then bent upwardly to wrap under the bottom of the board, with its end terminating at a point between two spaced slots. The end of the short leg may also be staked into the bottom of the board. This kind of structure frequently fails because, when relatively small forces are applied to the extending terminal end of the contact strap, the wrapped-around portion of the strap can open and less securely grip the board. On occasion relatively small forces can pull the strap completely off the board.

BRIEF DESCRIPTION OF THE INVENTION

In accordance with the present invention, a novel strap structure is provided and a novel process for fixing the strap structure to an insulation board is provided, wherein the strap is physically and positively locked to the board.

The terminal or contact strap of the invention is bent to a U shape having a bottom which is generally flat and may be slightly peaked or arcuate. A frangible section is formed in one leg of the U shape adjacent the base of the U. The frangible section can be more easily distorted than the other regions of the strap surrounding the frangible section. Preferably, the frangible section is placed in a region centrally of the strap width. The other leg of the U-shaped strap has a length slightly greater than the distance between parallel slots which receive the U-shaped member on the insulation board. One or more U-shaped conductive straps are then loaded into preformed slots in the board which all generally conform in shape to the cross-section of the straps. Note that the frangible section which was preformed in each strap does not prevent insertion of the strap through the slot which receives the frangible section-containing leg. Thereafter, the legs of the U-shaped members which do not contain the frangible section are bent upwardly and under the insulation board until their free ends engage respective frangible sections. This engagement will rupture the frangible sections or otherwise press them laterally outwardly of the leg of the U which contains them and beyond the edges of the slots which received the legs with the frangible sections. This will then lock those legs to the board, with the free end of the other legs of the U-shaped terminals also being latched into their respective frangible regions, thereby requiring relatively great force to loosen or remove the terminals from the board.

The frangible section is preferably one which has been weakened as by a stamping process prior to the bending of the contact to its U shape and its loading into the slots of the insulation board. The frangible section can also have other structures. By way of example, instead of a weakened stamped region, the frangible section may be formed by two spaced, parallel slits through the legs of the terminal which are spaced from one another to define a relatively easily deformable region in the center of the terminal width. Alternatively, a single slit can be made transverse to the length of the strap and at a region which would lie just beneath the insulation board which receives the strap. This pre-slit region can deform when engaged by an end of the strap which is wrapped under the board to be pressed beyond the edge of the insulation board slot, thus locking the terminal to the board.

While the frangible region is located in the center of the strap in the preferred embodiment of the invention, it will be apparent to those skilled in the art that the frangible region could be displaced toward the edge of the strap width. The frangible section could also consist of two spaced frangible regions on the opposite edges of the strap. Whichever system is used, the free end of the opposite leg of the U-shaped strap should be suitably conformed so that it will press into and deform the frangible region wherever it may be located in the width of the strap.

DETAILED DESCRIPTION OF THE DRAWINGS

Figure 3:
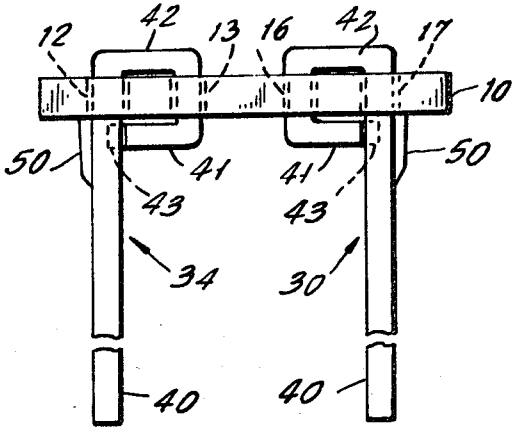
FIG. 3 is a side view of FIG. 2.

Referring to the drawings, there is illustrated in FIGS. 1 to 3, 7 and 8 an insulation board 10 of conventional structure. By way of example, the board 10 may be of XP phenolic material and may have a thickness of 0.062 inches, a length of 1.190 inches and a width of 0.552 inches. The length and width of the board are given herein for an example in which the board contains eight contact terminals. Obviously, other dimensions for the board and other contact configurations could be used.

The board 10 has eight pairs of parallel slots formed therein. Portions of these slots are exaggerated in FIG. 2 for clarity and are seen as slot pairs 12–13, 14–15, 16–17 and 18–19 for four of the contacts seen in FIG. 2. For exemplary purposes, each of slots 15 through 19 may have a width of 0.030 inches and a length of 0.135 inches.

Figure 1:
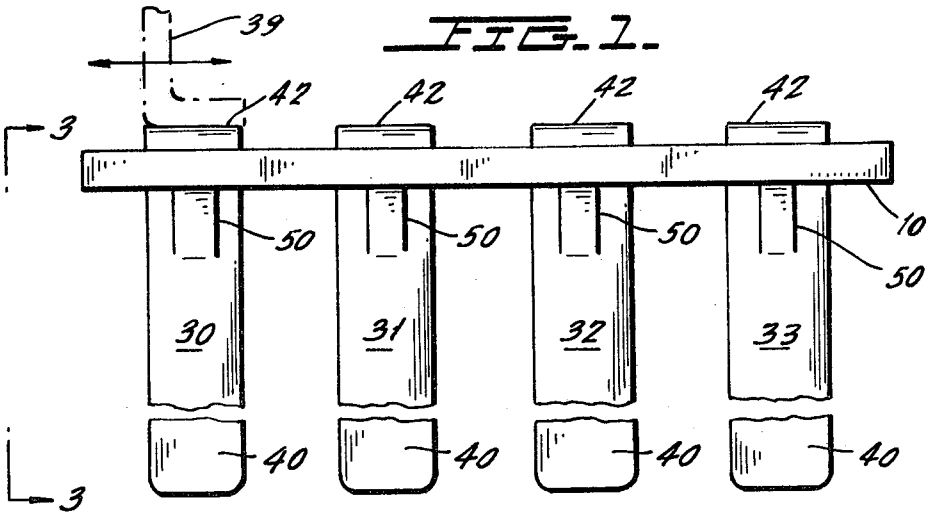
FIG. 1 is an elevation view of an insulation board carrying a plurality of contact terminals and further schematically illustrates in dotted lines a sliding contact which cooperates with the upper contact surfaces formed by the terminals.
Figure 2:
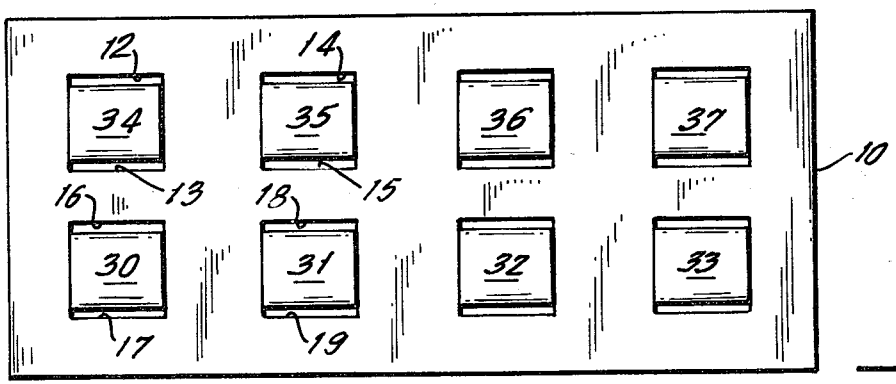
FIG. 2 is a top view of FIG. 1.

As shown in FIGS. 1 to 3, the pairs of slots respectively receive electrical contact terminals 30 to 37.

FIG. 1 also discloses the manner in which a sliding contact 39 may be used to ride over and engage the top surfaces of contacts 30 to 37 in order to make electrical contact between the circuit connected to the individual contact and a circuit connected to the sliding contact. Note that individual sliding contacts such as contact 39 can be arranged to make contact with each row of contacts 30, 31, 32 and 33 and another for contacts 34, 35, 36 and 37.

Figures 4, 5, 6:
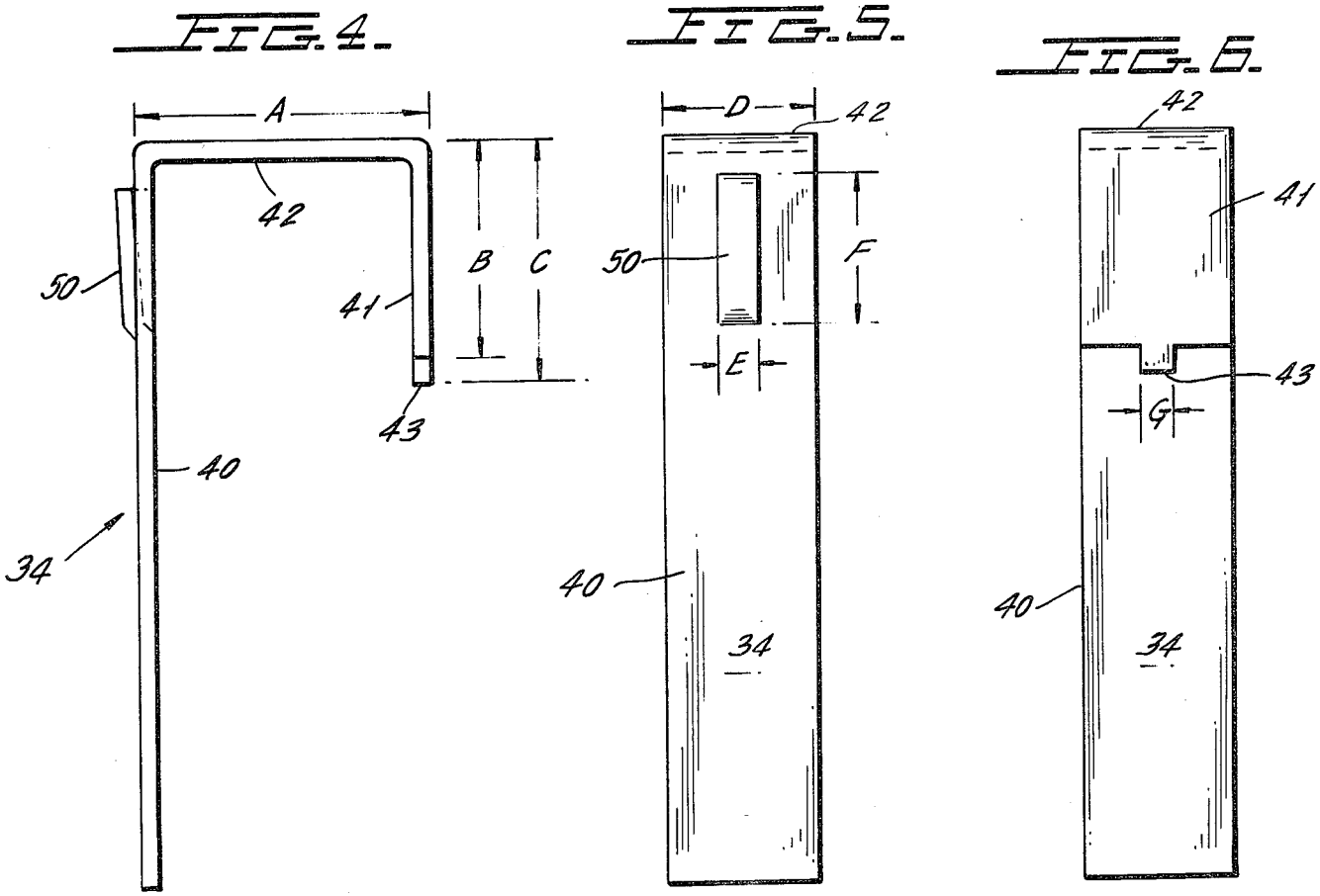
FIG. 4 is an end view of one of the contact terminals of FIGS. 1 to 3.
FIG. 5 is a view of the contact of FIG. 4 when seen from the left in FIG. 4.
FIG. 6 is a view of the contact of FIG. 4 when seen from the right in FIG. 4.

Each of contact terminals 30 to 37 has an identical structure which is typically shown in FIGS. 4 through 8 for the case of contact 34. Thus, as shown in FIGS. 4, 5 and 6, each of the contact terminals consists of an elongated conductive strap, preferably of copper, which is bent to the shape of a U. This U shape consists of legs 40 and 41 which are joined by a base 42 which is generally flat as shown, but may be slightly arcuate or peaked. In the exemplary embodiment, the strap forming contact 34 has a thickness of 0.020 inches, a width of 0.125 inches and a total length of 0.850 inches. The leg 40 may have any desired length since this is the leg which serves as an elongated terminal disposed beneath the insulation board. The leg 41, however, has a critical length B in FIG. 4, which must equal the length A of the base 42 for reasons which will become apparent. Moreover, the leg 41 has an extending tang 43 which has an additional length of approximately 0.027 inches.

The leg 40 is formed with a frangible section 50 as shown in FIGS. 4 and 5, where the frangible section 50 is one which is more easily laterally deformable (deformable out of the plane of the strap) than the surrounding main region of the leg 40. The frangible section 50 is placed at a point on the leg 42 which will be located immediately under the surface of the insulation board 10 when the strap is loaded into the board. Frangible section 50 is preferably wider than tang 43. The frangible section 50 can be formed by many processes. For example, it can be formed by stamping a weakened or thinner section into the material. Alternatively, it can be formed by slitting along the vertical sides of section 50 in FIG. 5 or it can be formed by placing a slit at the top of the frangible region 50 which can be deformed outwardly. The frangible section 50 is located centrally of the width of leg 40 and in alignment with the extending tang 43 at the end of leg 51. Frangible section 50 is of such a nature that it permits insertion of leg 40 through the slit which receives the leg without requiring undue widening of the slit.

Figure 8:
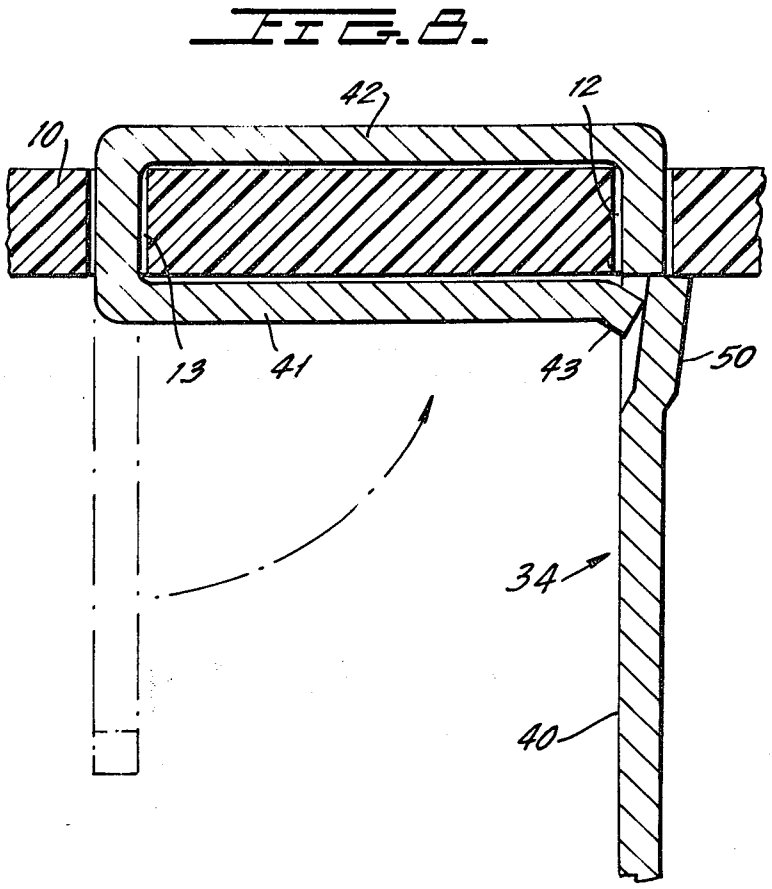
FIG. 8 is an enlarged view similar to FIG. 7 but shows the free end of one of the contacts rotated upwardly into locking position and rupturing the frangible section in the opposite leg to latch the entire contact terminal to the insulation board.
Figure 7:
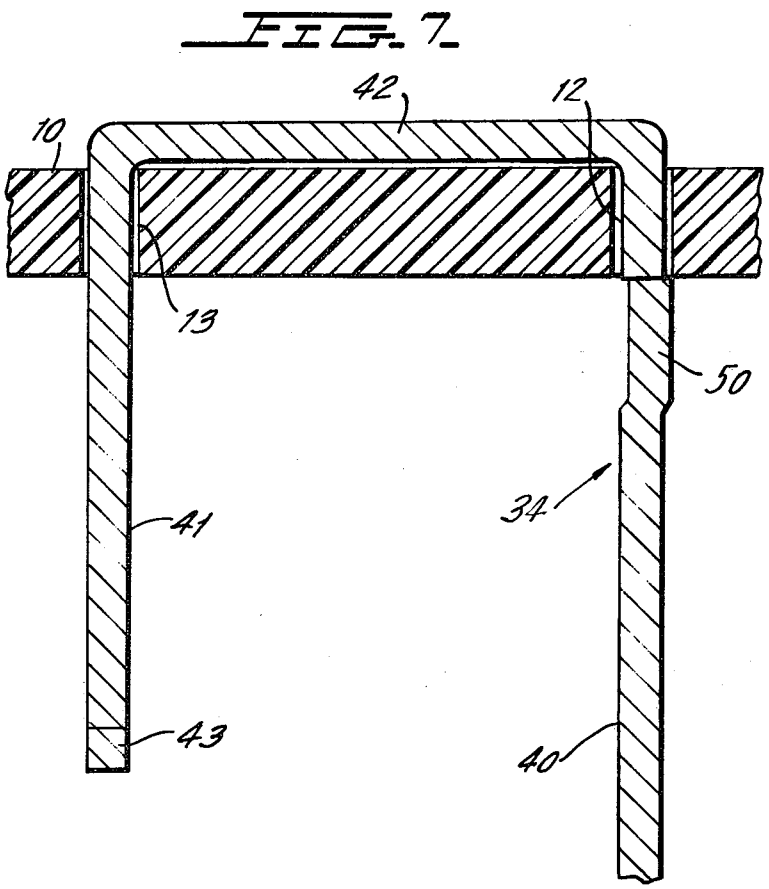
FIG. 7 is an enlarged view of a single contact and the insulation board of FIGS. 1 to 3 after the contact has been loaded into a pair of spaced slots.

FIGS. 7 and 8 illustrate the manner in which the terminal of the novel invention is installed.

As shown in FIG. 7 and in order to assemble the contact and the insulation board, the U-shaped contact is simply loaded into the spaced slots 12 and 13, with the long leg 40 of the contact facing the outside of the printed circuit board as shown in FIG. 3. Frangible section 50 does not protrude laterally beyond the surface of the strap to the extent that it prevents passage through its cooperating slot.

After the U-shaped contacts have been loaded, the base section 42 lies flush with the web between slots 12 and 13. A suitable fixture or die is then used to force the leg 41 to rotate from the position shown in FIG. 7 to the position shown in FIG. 8. This will bring the leg 41 flush against the bottom of the web of the insulation board between slots 12 and 13. During this operation, the tang 43 forcibly engages the frangible section 50 and causes it to deflect laterally from its position in FIG. 7 to the position of FIG. 8 where the frangible section is pressed past the edge of the slot 12 which receives the leg 40. Note also that the tang 43 is also distorted downwardly and tends to lock into the frangible section 50. Consequently, the entire terminal is securely locked or staked to the insulation board 12. In order to remove or loosen the terminal, sufficient force is needed to tear the frangible section through the edge of the slit and to distort tang 43 out of engagement with section 50. It is unlikely that this kind of force would unintentionally be applied to the terminal.

It will be understood that the frangible section 50 could take many forms. In FIG. 8, the frangible section 50 is actually ruptured at its top where it is engaged by the tang 43. However, it can be sufficient simply to cause the frangible section to bulge out beneath and to the right of the edge of slot 12 in order to lock the terminal in place. Note also that the frangible section could have been located at other regions in the width of the leg 40 (laterally in the plane of the strap) and need not be located at its center.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. An assembled conductive terminal and an insulation board support therefor; said insulation board support comprising a thin board having at least first and second spaced, parallel slots therethrough and first and second parallel surfaces; said conductive terminal comprising a thin, elongated strap of conductive material having a width substantially greater than its thickness; said strap having a first portion extending through said first slot and extending away from said first surface of said board and being connectable to an external electrical circuit; said first portion of said strap having a frangible region immediately adjacent said first surface; said frangible region being more easily laterally distorted than regions removed from said frangible region; said strap having a second portion which is continuous with said first portion and which is bent to overlie said second surface between said first and second slots; said strap having a third portion which is continuous with said second portion and which extends through said second slot and is bent to overlie said first surface between said first and second slots; said third portion having a free end which engages said first portion of said strap at its said frangible region and which presses said frangible region laterally beyond the edge of said first slot, thereby to firmly secure said conductive terminal to said insulation board.

2. The structure of claim 1, wherein said frangible region is a region of reduced thickness which is formed by stamping.

3. The structure of claim 1, wherein said frangible region is ruptured at its upper end which is pressed beyond said edge of said first slot.

4. The structure of claim 1, wherein said conductive terminal is made of copper.

5. The structure of claim 1, wherein the surface of said second portion which is opposite the surface adjacent said second surface is a contact surface for making electrical contact with a second external circuit.

6. The structure of claim 1, which includes a plurality of said conductive terminals which are fixed to a plurality of pairs of said spaced, parallel slots.

7. The structure of claim 1, 2, 5 or 6, wherein said free end of said third portion has an extension which is centrally located in the width of said strap and wherein said frangible region is centrally located in said first portion.

8. The process of securing an electrical terminal strap to an insulation support board comprising the steps of: forming a short frangible section in a region of a thin contact strap; bending said thin contact strap to a generally U shape having a flat base, with said frangible section in one leg of said U-shaped strap adjacent to said base of said strap; inserting the ends of said U-shaped strap through respective spaced slots in an insulation support board until the interior of said base rests on the surface of said board wherein said slots generally conform in cross-section to the cross-section of the legs of said strap; bending one of the legs of said strap over the opposite surface of said board until it engages said frangible region of said one of said legs, and forces said frangible region to distort beyond the end of the slot through which it was inserted, thereby to firmly lock said terminal strap to said board.

9. The process of claim 8, wherein said frangible region is formed by stamping a weakened section into said strap before said strap is bent to its U shape.

10. The process of claim 8 or 9, wherein said frangible region is disposed centrally of the width of said strap.

* * * * *